US008640491B2

(12) United States Patent
Shoulders

(10) Patent No.: US 8,640,491 B2
(45) Date of Patent: Feb. 4, 2014

(54) DE-GASSING LUBRICATION RECLAMATION SYSTEM

(75) Inventor: Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 1833 days.

(21) Appl. No.: 11/910,992

(22) PCT Filed: Jul. 7, 2005

(86) PCT No.: PCT/US2005/024034

§ 371 (c)(1),
(2), (4) Date: Oct. 9, 2007

(87) PCT Pub. No.: WO2007/008193

PCT Pub. Date: Jan. 18, 2007

(65) Prior Publication Data

US 2008/0210601 A1 Sep. 4, 2008

(51) Int. Cl.
*F25B 41/04* (2006.01)

(52) U.S. Cl.
USPC ..... 62/498; 208/184

(58) Field of Classification Search
USPC ..... 62/498
See application file for complete search history.

(56) References Cited

U.S. PATENT DOCUMENTS 3,496,992 A * 2/1970 Leonard, Jr. ..... 165/62
3,795,816 A 3/1974 Frei
4,671,081 A 6/1987 Fujiwara
5,024,061 A * 6/1991 Pfeil et al. ..... 62/77
5,570,579 A 11/1996 Larjola (Continued)

FOREIGN PATENT DOCUMENTS

EP 1087190 3/2001

OTHER PUBLICATIONS

International Preliminary Report on Patentability dated Mar. 19, 2009.

(Continued)

*Primary Examiner* — Ellen McAvoy
*Assistant Examiner* — Ming Cheung Po
(74) *Attorney, Agent, or Firm* — Carlson, Gaskey & Olds, PC

(57) ABSTRACT

A vapor compression system (10), also known as a chiller, includes a refrigeration loop and a lubrication loop. The lubrication loop includes a lubrication reclamation system that further includes a still (42) and an ejector (44) to reduce a pressure in the still (42). The ejector (44) includes an input portion (46), an output portion 54 and a vent portion (50). The input portion (46), the output portion (54) and the vent portion (50) are in fluid communication with one another. The vent portion (50) of the ejector (44) is positioned in a vent line (48) associated with the still (42). The still (42) primarily contains a mixture of liquid refrigerant and lubricant. The input portion (46) of the ejector receives liquid or gas at a high pressure and expels the liquid or gas through the output portion (54) at an intermediate pressure. As the input fluid at a high pressure flows through the ejector (44), a low pressure is created at the vent portion (50). The reduction in pressure in the vent portion (50) causes a suction pressure within the vent portion (50) associated with the still (44), resulting in a portion of the liquid refrigerant vaporizing, leaving a higher viscosity lubricant.

20 Claims, 2 Drawing Sheets

(56) References Cited

U.S. PATENT DOCUMENTS

| | | | | |
|---|---|---|---|---|
| 5,740,681 | A * | 4/1998 | Karl | 62/324.6 |
| 6,082,982 | A * | 7/2000 | Rosser et al. | 418/97 |
| 2002/0134103 | A1 | 9/2002 | Nishii | |
| 2005/0011221 | A1 * | 1/2005 | Hirota | 62/500 |

OTHER PUBLICATIONS

International Search Report and Written Opinion, dated Jul. 8, 2008.

* cited by examiner

DE-GASSING LUBRICATION RECLAMATION SYSTEM

TECHNICAL FIELD

The present invention relates to vapor compression systems, and more particularly to a vapor compression system used in a "chiller" system that has a flooded evaporator and a generator vessel or still to separate lubricant from liquid refrigerant.

BACKGROUND OF THE INVENTION

Chillers, which are used to cool vast interior spaces such as airport terminals, shopping malls and officer towers, include vapor compression systems that generally comprise a refrigeration loop and a lubrication loop. The refrigeration loop includes a condenser, an expansion device, an evaporator or cooler, and a compressor. The lubrication loop also includes the compressor and is designed to provide lubrication to the compressor. Because the refrigeration loop and the lubrication loop intersect in the compressor, liquid refrigerant from the refrigeration loop and lubricant from the lubrication loop are allowed to intermingle resulting in a mixture of liquid refrigerant and lubricant. The lubricant-refrigerant mixture collects in the evaporator, where it may degrade the heat transfer capability of the system if not reclaimed. Because the viscosity of the refrigerant is much lower than the viscosity of the lubricant, the lubricant-refrigerant mixture formed has a viscosity that is much lower than necessary for adequate lubrication of the compressor. Therefore, upon reclamation, the lubricant-refrigerant mixture may not be suitable for use as a lubricant.

Accordingly, known chillers incorporate a generator vessel or a still to address this concern. The still, which is actually a concentrator, functions to remove the oily refrigerant from the evaporator and to separate the lubricant from the liquid refrigerant. Conventional stills accomplish this by boiling off the refrigerant through the addition of heat, leaving an oil-rich mixture with a high enough viscosity as to be suitable for use as a lubricant. However, at some pressure-temperature conditions encountered by chillers, it can be difficult to develop adequate lubricant viscosity by the conventional method of adding heat. Furthermore, even if adequate lubricant viscosity can be achieved by heat addition alone, to achieve this viscosity would require the addition of a substantial amount of heat resulting in an undesirable reduction of chiller energy efficiency.

As such, there is a desire for a lubrication reclamation system that is operable to remove refrigerant from a lubricant-refrigerant mixture without the substantial heat input required by traditional systems.

SUMMARY OF THE INVENTION

The present invention is directed to a vapor compression system for use in a chiller. The vapor compression system includes a lubrication reclamation system, or still, which incorporates an ejector to reduce a pressure in the still. The ejector includes an input portion, an output portion and a vent portion. The input portion, the output portion and the vent portion are in fluid communication with one another. The still primarily contains a mixture of liquid refrigerant and lubricant. The vent portion of the ejector is positioned in a vent line associated with the still. The input portion of the ejector receives liquid or gas at a high pressure. As an input fluid at a high pressure flows through the ejector, a low pressure is created at the vent portion resulting in refrigerant vapor from the still flowing into the ejector through the vent portion.

The fluid flow into the input portion is at an input pressure and the fluid flowing into the vent portion is at a vent pressure. The flow from the input portion and the flow from the vent portion combine within the ejector and are expelled through an output portion at an output pressure that is intermediate to the input pressure and the vent pressure. The reduction in pressure created at the vent portion is fluidly communicated to the still through the vent line. This causes a portion of the liquid refrigerant from within the still to vaporize and flow into the vent line, through the vent portion, into the ejector and exit through the outlet portion and leaves the remaining lubricant-refrigerant mixture within the still at a higher viscosity.

In one embodiment, the ejector operates any time the chiller operates. In another embodiment, the ejector operates intermittently, i.e., driven only at times when the suction pressure is in a range where developing a sufficiently high lubricant viscosity is difficult using conventional means given the pressure-temperature conditions.

These and other features of the present invention can be best understood from the following specification and drawings, the following of which is a brief description.

DETAILED DESCRIPTION OF THE PREFERRED EMBODIMENTS

Figure 1:
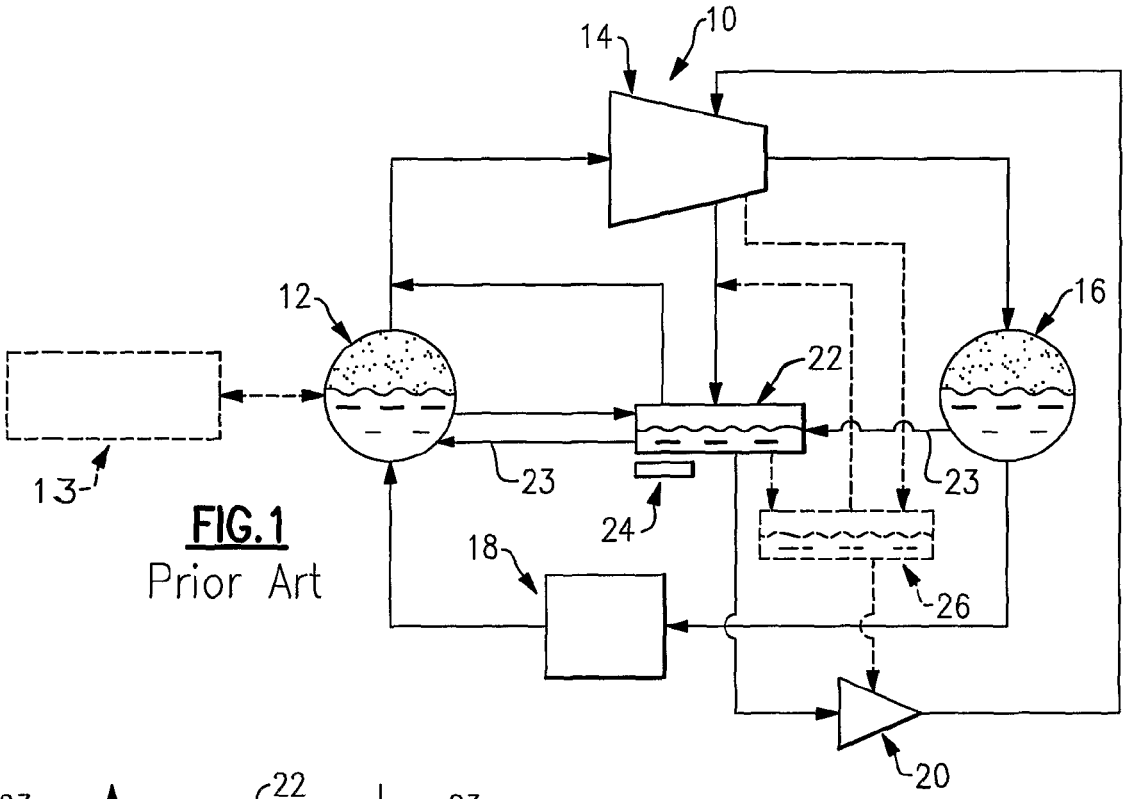
FIG.1 Prior Art
FIG. 1 is a schematic illustration of a known vapor compression system including a refrigeration loop and a lubrication loop.

FIG. 1 is a schematic illustration of a known vapor compression system 10 including a refrigeration loop and a lubrication loop. The refrigeration loop includes an evaporator 12, a compressor 14, a condenser 16 and an expansion device 18. The lubrication loop includes the compressor 14, an oil pump 20 and a still 22.

In the refrigeration loop, the evaporator 12 delivers a gaseous refrigerant to the compressor 14 where the gaseous refrigerant is compressed. The compressed, gaseous refrigerant is delivered to the condenser 16 where the compressed, gaseous refrigerant is cooled to a liquid phase and transferred through the expansion valve 18 back to the evaporator 12. Further, in a chiller system, heat is exchanged between the evaporator 12 and a chiller 13 shown in phantom.

In the lubrication loop, the oil pump 20 supplies lubricant to the compressor 14 for lubrication. Because the compressor 14 is part of both the refrigeration loop and the lubrication loop, some of the refrigerant from the refrigeration loop mixes with the lubricant from the lubrication loop in the compressor 14 to form a lubricant-refrigerant mixture. The presence of refrigerant in the lubricant is undesirable because the lubricant-refrigerant mixture has a lower viscosity than the lubricant alone. As such, the lubricant-refrigerant mixture is routed to the still 22 where heat is introduced to boil off the refrigerant from the lubricant-refrigerant mixture, resulting in a liquid of increased viscosity. Heat may be added through the incorporation of an electric heater 24 into the still 22 and/or by using hot refrigerant gas flow through isolated lines (not shown) passing through the still 22. In addition, an optional lubricant reservoir 26, shown in phantom, may be included in the lubrication loop.

At some pressure-temperature conditions encountered by the vapor compression system 10, however, it can be difficult to obtain adequate lubricant viscosity by the conventional means of adding heat. Further, even if adequate lubricant viscosity can be achieved by the addition of heat alone, to achieve this viscosity requires the addition of a substantial amount of heat to the vapor compression system 10, which results in an undesirable reduction in system energy efficiency.

Figure 1A:
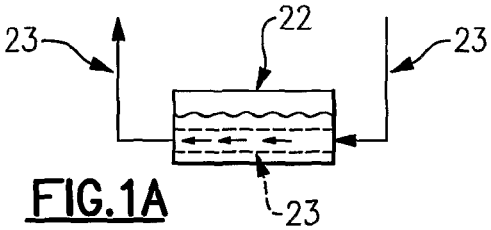
FIG.1A Prior Art
FIG. 1A is a schematic illustration of a known still incorporating heating tubes.
Figure 2:
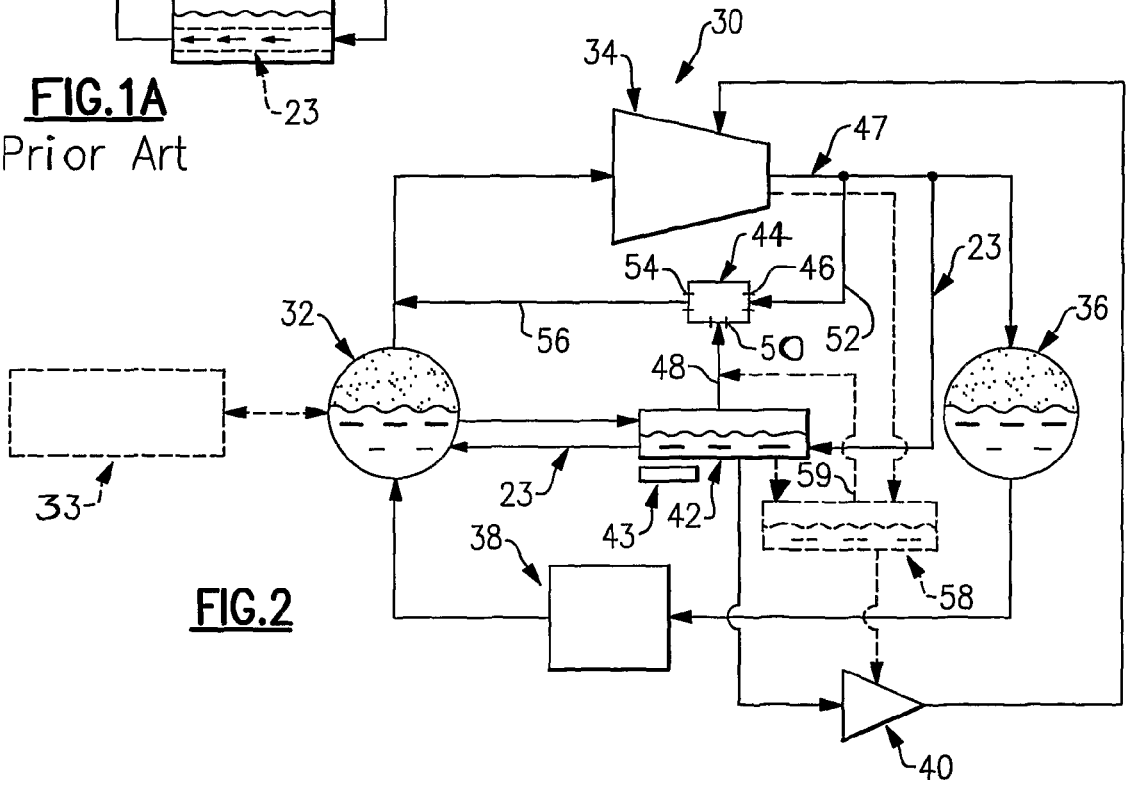
FIG. 2 is a schematic illustration of a vapor compression system including a refrigeration loop, a lubrication loop and one embodiment of the present invention.

FIG. 1A is a schematic illustration of a known still 22 incorporating a heating tube 23 to provide heat to the still 22. A heated fluid flows through the heating tube 23, which runs through the still 22, to introduce heat to the lubricant-refrigerant mixture in the still 22. The heated fluid could be either a heated liquid, received from the condenser 16 (FIG. 1) or, or a heated gas, received from a compressor output line 47 (FIG. 2). The heated fluid flows through the heating tube 23 positioned within the still 22, and is returned to the evaporator 12 (FIG. 1).

FIG. 2 is a schematic illustration of a vapor compression system 30 including a refrigeration loop, a lubrication loop and an ejector according to one embodiment of the present invention. In the refrigeration loop, an evaporator 32 delivers a refrigerant gas to a compressor 34 where the refrigerant gas is compressed. Compressed, gaseous refrigerant is delivered to the condenser 36 where the compressed, gaseous refrigerant is cooled to a liquid phase and transferred through an expansion valve 38 back to the evaporator 32. Further, in a chiller system, heat is exchanged between the evaporator 32 and a chiller 33, shown in phantom.

In the lubrication loop, an oil pump 40 supplies lubricant to the compressor 34 for lubrication. As shown in the known vapor compression system 10 (FIG. 1), because the compressor 34 is part of both the refrigeration loop and the lubrication loop, some of the refrigerant from the refrigeration loop mixes with the lubricant from the lubrication loop in the compressor 34 to form a lubricant-refrigerant mixture. As such, a still 42 is included to provide lubricant of an increased viscosity by removing refrigerant from the lubricant-refrigerant mixture. In the still 42, heat may be added through the incorporation of an electric heater 43 to the still 42 and/or by using hot refrigerant gas flow received from a compressor output line 47 through a heating tube 23, which is isolated within the still 42 as shown in FIG. 1A, or through other isolated lines (not shown) passing through the still 42.

However, to increase the viscosity of the lubricant in the still 42 without the addition of an excessive amount of heat, an ejector 44 is positioned in fluid communication with both the refrigeration loop and the lubrication loop. The ejector 44 may include but is not limited to a jet pump or a supersonic nozzle. In this example, the ejector 44 is in operation during the same period of time that the vapor compression system 30 is in operation. Alternatively, the ejector 44 can be operated intermittently, i.e. only driven a times when, if the ejector 44 is not driven, a pressure and a temperature within the still 42, are within a range where developing a lubricant of sufficient viscosity is difficult by conventional means of adding heat alone.

The ejector 44 includes three (3) ports: two input ports and one output port. A high pressure fluid, e.g. a liquid or a gas, is introduced through a first input port 46 and passes through the ejector 44 creating a low pressure region downstream of the first input port 46. A second input port 50 is located in the vicinity of the low pressure region and is in fluid communication with the still 42 through the vent line 48.

In one example system, the first input port 46 receives high pressure refrigerant gas from a high pressure gas drive line 52. The low pressure created at the second input port 50 is fluidly communicated through the vent line 48 to the interior of the still 42. This decrease in pressure causes some of the liquid refrigerant from the lubricant-refrigerant mixture in the still 42 to vaporize and to form a refrigerant gas. The second input port 50 receives the refrigerant gas from the vent line 48 associated with the still 42. The fluid streams from the first input port 46 and the second input port 50 combine within the ejector 44 and are discharged at an output pressure through an output port 54 into an ejector discharge line 56. The output pressure is less than the input pressure of the fluid received into the first input port 46 and greater than the input pressure of the fluid received into the second input port 50.

As a result of the vaporization event, the liquid remaining in the still 42 is less diluted with refrigerant and, therefore, provides a more oil-rich, (i.e. a higher viscosity) liquid for use as a lubricant delivered to the pump 40. Therefore, the use of the ejector 44 increases the viscosity of the lubricant without the addition of an excessive amount of heat. Further, by incorporating a suitably sized ejector 44, the addition of heat may not be required at all to achieve adequate lubricant viscosity at some operating conditions.

Optionally, a lubricant reservoir 58 (shown in phantom) may be included in the lubrication loop. If included, lubricant from the still 42 is further refined or filtered prior to entering the lubrication reservoir 58. From the lubrication reservoir 58, lubricant is then supplied to the oil pump 40. A reservoir vent line 59 connecting the reservoir 58 to the vent line 48, may also be included to maintain a suitable viscosity.

Figure 3:
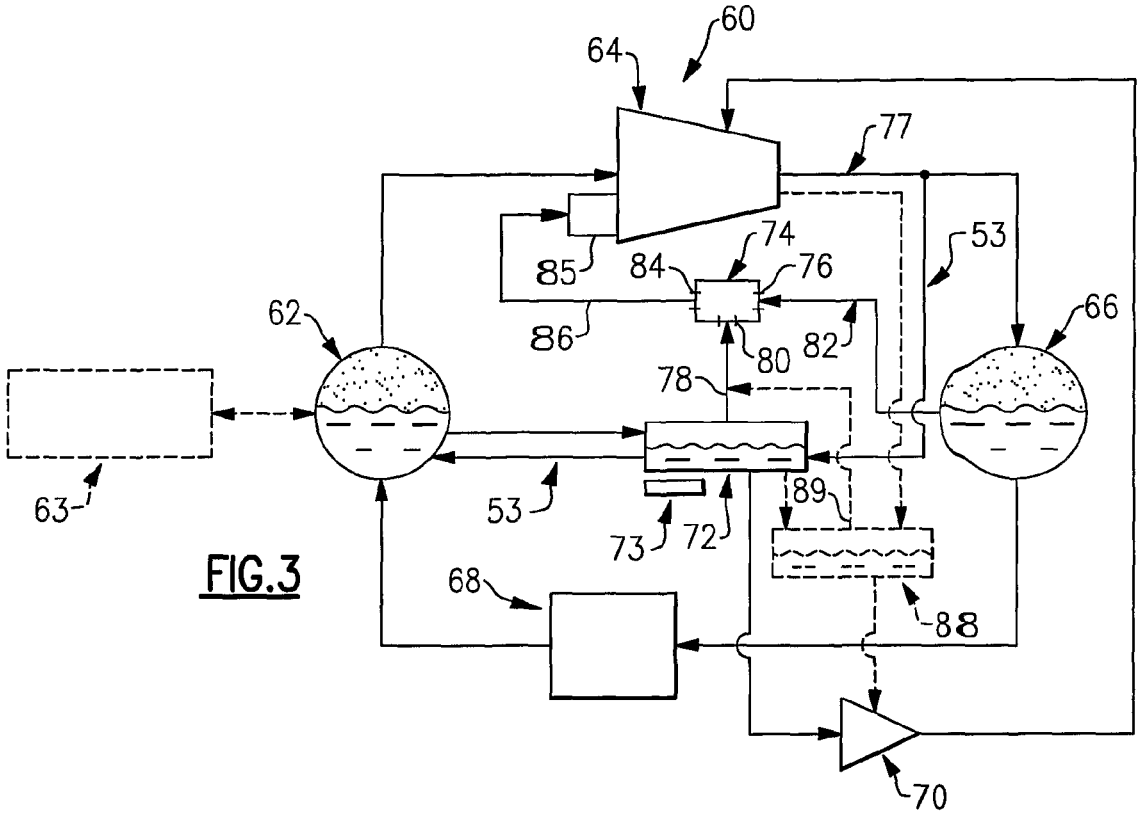
FIG. 3 is a schematic illustration of a vapor compression system including a refrigeration loop, a lubrication loop and another embodiment of the present invention.

FIG. 3 is a schematic illustration of a vapor compression system 60 including a refrigeration loop, a lubrication loop and another embodiment of the present invention. The vapor compression system 60 of FIG. 3 is similar to layout and function to the vapor compression system 30 of FIG. 2. As such, similar components are indicated by reference numbers increased by a value of 30. However, in the lubrication loop of FIG. 3, an ejector 74 is driven by high pressure liquid instead of being driven by high pressure gas as described in FIG. 2.

In FIG. 3, a first input port 76 of the ejector 74 receives high pressure liquid from the condenser 66 through a high pressure liquid drive line 82. The low pressure created at a second input port 80 is fluidly communicated through a vent line 78 to the interior of a still 72. This decrease in pressure causes some of the liquid refrigerant from the lubricant-refrigerant mixture in the still 72 to vaporize and to form a refrigerant gas. The second input port 80 receives the refrigerant gas from the vent line 78 associated with the still 72. The fluid streams from the first input port 76 and the second input port 80 combine within the ejector 74 and are discharged at an output pressure through an output port 84 into an ejector discharge line 86. The output pressure is less than the input pressure of the fluid received into the first input port 76 and greater than the input pressure of the fluid received into the second input port 80. As a result of the vaporization event, the liquid remaining in the still 72 is less diluted with refrigerant and, therefore, provides a more oil-rich, (i.e. a higher viscosity) liquid for use as a lubricant delivered to the pump 70.

Further, the use of high pressure liquid refrigerant to drive the ejector 74 may have several advantages over the use of high pressure refrigerant gas. For example, as illustrated in FIG. 3, where a liquid refrigerant stream is required for another aspect of system operation, e.g., for cooling an electric motor 85. The addition of the cooling function may be combined with the function of driving the ejector 74. The fluid, discharged through the output port 84 of the ejector 74, flows through the ejector discharge line 86 into the electric motor 85, which drives the compressor 64, to provide cooling to the electric motor 85. As a further benefit, with the use of the higher density liquid for driving the ejector 74, the system 60 is able to accommodate a higher flow rate of gas through the vent line 78. This allows a greater rate of refrigerant vaporization out of the lubricant-refrigerant mixture in the still 72.

Figure 4:
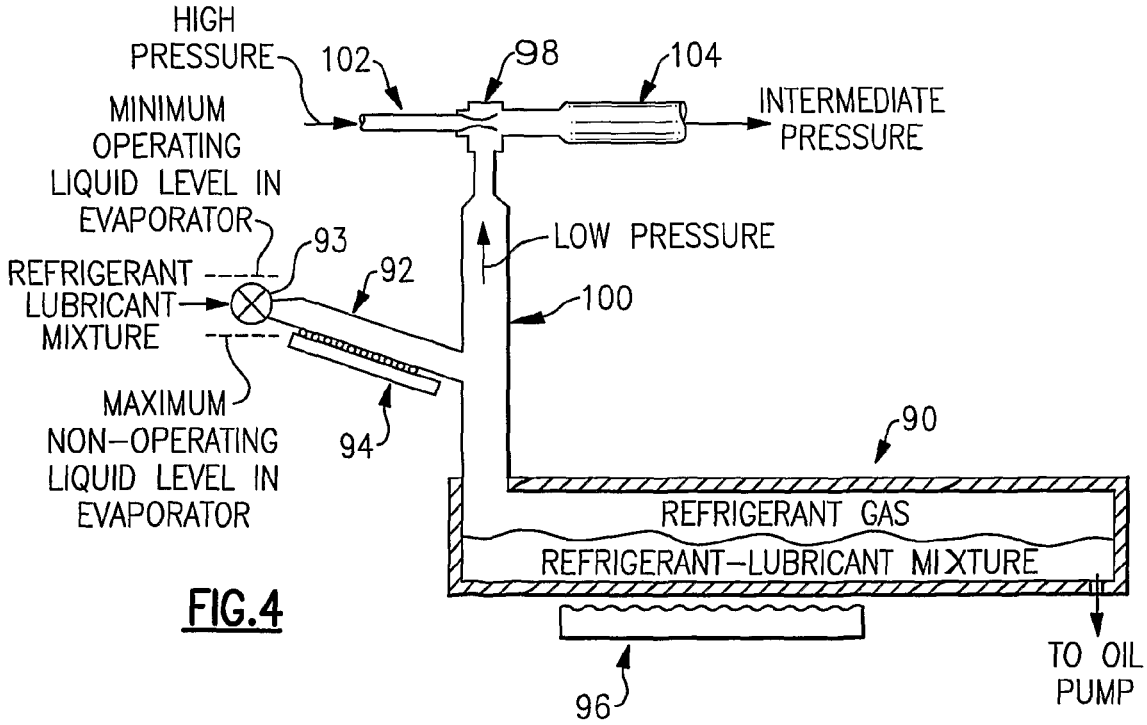
FIG. 4 is a detailed illustration of a still including an example embodiment of the present invention.

FIG. 4 is a detailed illustration of a still including an example embodiment according to this invention. A still 90 contains both lubricant-refrigerant mixture and refrigerant gas. In this illustration, lubricant-refrigerant mixture passes through an inlet line 92 into the still 90. As is known, the inlet line 92, is positioned at a location relative to an evaporator (not shown) such that the connection of the inlet line 92 to the evaporator (not shown) is below, in the direction of gravity, a minimum operating liquid level in the evaporator and above a maximum non-operating liquid level in the evaporator. Alternatively, the connection of the inlet line 92 to the evaporator (not shown) may be located below, in the direction of gravity, both a minimum operating liquid level and a maximum non-operating liquid level, if a shut-off valve (not shown) is used to prevent the flow of refrigerant into the inlet line 92 during periods of non-operation. An orifice or a controlled regulating valve 93 may be located between the evaporator (not shown) and the still 90 in the inlet line 92. The controlled regulating valve 93 may be used to regulate the flow of lubricant-refrigerant within the inlet line 92 and to the still 90.

The inlet tube 92 is preferably flat-bottomed and may also include features such as dams, ribs, spreaders or deflectors to evenly distribute flow and/or make the flow insensitive to leveling.

A first electric heater 94, optionally installed along a bottom edge of the inlet line 92, introduces heat into the lubricant-refrigerant mixture resulting in vaporization of some of the liquid refrigerant. A second electric heater 96 is optionally installed at a bottom edge of the still 90 or inserted within the still 90 below the liquid level. The second electric heater is operable to introduce additional heat, resulting in more of the liquid refrigerant from the lubricant-refrigerant mixture flashing to gas. Either electric heater 94 or 96, if used, may be regulated or operated intermittently as required.

An ejector 98 is connected to a vent line 100 that vents refrigerant gas from a still 90. The ejector 98 receives a high pressure fluid, (e.g. a high pressure refrigerant gas or a high pressure liquid refrigerant), through an inlet line 102 and discharges a lower pressure fluid, (e.g. a lower pressure refrigerant gas or a lower pressure mixture of refrigerant gas and liquid refrigerant), through an outlet line 104. As the fluid passes through the ejector 98, a pressure drop is created in the vent line 100. This pressure drop creates a decrease in pressure in the still 90. This decrease in pressure causes some of the liquid refrigerant from the lubricant-refrigerant mixture in the still 90 to vaporize, forming a fluid flow through the vent line 100 and into the ejector 98.

As a result of the vaporization event, the remaining liquid in the still 90 provides a more oil-rich, (i.e. a higher viscosity) liquid for use as a lubricant without the addition of an excessive amount of heat. Further, by incorporating a suitably sized ejector 90, the addition of heat may not be required to achieve adequate lubricant viscosity at some operating conditions because adequate lubricant viscosity may be achieved through the pressure drop alone. As such, the electric heaters 94 and 96 may not be required under these operating conditions.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A lubrication reclamation system comprising:

a still;

an ejector including an inlet portion, an outlet portion, and a vent portion, wherein the vent portion is located in a vent line in fluid communication with the still, the inlet portion, the outlet portion and the vent portion being in fluid communication with one another, and the inlet portion receiving a fluid at a high pressure and the outlet portion expelling the fluid at a lower pressure: and said outlet portion for being connected to a suction section on a compressor.

2. The lubrication reclamation system as recited in claim 1 wherein the fluid received through the inlet portion is a gas.

3. The lubrication reclamation system as recited in claim 1, wherein the fluid received through the inlet portion is a liquid.

4. The lubrication reclamation system as recited in claim 1, wherein the ejector is a jet pump.

5. The lubrication reclamation system as recited in claim 1, wherein the ejector is a supersonic nozzle.

6. The lubrication reclamation system as recited in claim 1, further including at least one heating device.

7. The lubrication reclamation system as recited in claim 6, wherein the at least one heating device is an electric heater.

8. The lubrication reclamation system as recited in claim 7, wherein the at least one electric heater is located proximate to the still.

9. The lubrication reclamation system as recited in claim 6, wherein the at least one heating device includes at least one tube through which a hot fluid is flowed.

10. The lubrication reclamation system as recited in claim 9, wherein the at least one tube is located proximate to the still.

11. The lubricant reclamation system as recited in claim 1, wherein a lubricant return line leaves said still, and is to be connected to a compressor.

12. The lubricant reclamation system as recited in claim 1, wherein the inlet portion is connected to receive a refrigerant at least partially compressed by a compressor.

13. A vapor compression system comprising:

a condenser;

an expansion device;

an evaporator;

a compressor, and a refrigerant circulatingfrom the compressor to the condenser, the expansion device and the evaporator;

a lubrication reclamation system including a still, and an ejector, the ejector comprising an inlet portion, an outlet portion a vent portion located in a vent line in fluid cormnunication with the still;

the inlet portion the outlet portion and the vent portion being in fluid communication with one another:

the inlet portion receivin a fluid at a high pressure and the outlet portion expelling the fluid at a lower pressure: and said outlet portion of said injector communicating to a suction location on said compressor.

14. The vapor compression system as recited in claim 13, wherein the fluid received through the inlet portion is a gas.

15. The vapor compression system as recited in claim 13 wherein the fluid received through the inlet portion is a liquid.

16. The vapor compression system as recited in claim 13, further including at least one heating device.

17. The vapor compression system as recited in claim 16, wherein the at least one heating device is an electric heater.

18. The vapor compression system as recited in claim 16, wherein the at least one heating device includes at least one tube through which a hot fluid is flowed.

19. The vapor compression system as recited in claim 13, wherein said still including a lubricant return line which communicates back to the compressor.

20. The vapor compression system as recited in claim 13, wherein the inlet portion of the injector is connected to receive a refrigerant which has been at least partially compressed by the compressor.

* * * * *